US006926625B1

(12) United States Patent
Fruechting

(10) Patent No.: US 6,926,625 B1
(45) Date of Patent: Aug. 9, 2005

(54) BATTING STANCE GUIDE DEVICE

(76) Inventor: Eric R. Fruechting, 7006 E. La Cumbre Dr., Orange, CA (US) 92869-4432

( * ) Notice: Subject to any disclaimer, the term of this patent is extended or adjusted under 35 U.S.C. 154(b) by 26 days.

(21) Appl. No.: 10/803,451

(22) Filed: Mar. 19, 2004

(51) Int. Cl.[7] ..... A63B 69/00
(52) U.S. Cl. ..... 473/452; 473/422; 473/218; 473/270
(58) Field of Search ..... 473/218, 270, 473/271, 273, 422, 452, 497, 499, FOR 103; 482/142, 146

(56) References Cited

U.S. PATENT DOCUMENTS 3,041,075 A * 6/1962 Taylor ..... 473/218
4,248,431 A * 2/1981 Burnes ..... 473/270
4,407,233 A * 10/1983 Bozzacco ..... 359/518
4,932,656 A * 6/1990 Pierce ..... 473/452
5,607,150 A * 3/1997 Schnorr, III ..... 473/499

* cited by examiner

*Primary Examiner*—Stephen Blau
*Assistant Examiner*—M. Chambers
(74) *Attorney, Agent, or Firm*—John E. Vandigriff

(57) ABSTRACT

A batter stance training device is place beside the batting plate to train young batters the proper position of feet, and the proper step forward position during batting. A first strip of material is placed along side a batting plate. On the strip of material are three foot position devices that are movably attached to the strip of material to indicate the batter's feet position during batting. Additional strips of material may be attached to the first strip of material to form a batting box in which the batter stands during batting. The first strip may have indicia thereon so that the positioning of strips of material to indicate the batter's feet position may be noted for each batter. The strips and foot placement devices may be made of flexible material, for example, heavy cloth, canvas, and various plastic materials.

18 Claims, 3 Drawing Sheets

BATTING STANCE GUIDE DEVICE

FIELD OF THE INVENTION

The invention relates to batting training devices, and more particularly to a foldable and portable device for training proper foot positioning for batting positions and stance.

BACKGROUND OF THE INVENTION

The proper position of a batter's feet is desirable to enable the batter to maximize the batters hitting skills. Various devices have been made to train the batter where to initially position his feet, and then show a step forward position as the batter steps forward to hit a ball. Most of the prior art stance guide devices are bulky, and some cannot be disassembled or folded to allow it to be easily carried or stored. The following listed patents are give by way of example to show existing prior art patented device, but are not considered to show or describe the novel features of the present invention.

U.S. Pat. No. 5,613,677, describes a batter training device for training a batter to effectively strike a baseball by controlling the batter's stance. The device is positioned on the ground in front of a leading foot of the batter. During the batter's swing, the batter steps forward with the leading foot until the leading foot strikes the device. The device (includes a rear plate fixed to the ground and a forward plate) hingedly attached to the rear plate. A spring is oriented between the front plate and the rear plate. The device is oriented so that the front plate will be located adjacent to a final destination for the leading foot when the front plate has been pivoted towards the rear plate and against maximum spring compression.

U.S. Pat. No. 4,194,735 is a batting practice trainer for foot placement comprising two oppositely disposed flat support members having a home plate member disposed there between and attached thereto, and placement guide members comprised of pliable, yieldable material and having a pivot foot recess, a first stride foot recess parallel to the pivot foot recess, and a second stride foot recess therein, and mounted in opposing disposition on the top surface of each support member. The first stride foot recess is connected to the second stride foot recess to allow unencumbered passage of the stride foot of a batter during the swinging motion.

U.S. Pat. No. 4,516,772 describes a baseball batting trainer utilizing an elongated guiding rail, one end of which defines a positioner for the rear foot of a batter, there being a moving foot guide which slides along the rail while controlling the straddling movement of the front foot, and which hits a stop positioned on the rail at a certain point to define the furthermost position that the batter's front foot should assume before the swing. A rear stop behind the front foot guide defines the position of the front foot before the straddling movement starts, these stops being adjustable to accommodate the styles of different batters.

U.S. Pat. No. 4,932,656, describes a foot positioning training aid for training and instructing individuals in the proper positioning of their feet when engaged in various activities in which the position and movement of the feet are critical to proper execution of desired functions. The training aid includes a generally rectangular panel which can be supported on various supporting surfaces and is provided with a raised rear edge portion and raised side edge portions to position the feet but not form barriers to movement. The side edges of the training include progress numerical indicia and VELCRO alongside of the indicia together with positionable indicators on the VELCRO to provide indicators for initial position of the feet and also indicators to indicate movement or secondary positions of the feet for optimum performance of certain functions.

SUMMARY OF THE INVENTION

The invention is a batter stance training device that is place beside the batting plate to train young batters the proper position of feet, and the proper step forward position during batting. The stance training device includes a first strip of material that is placed along side a batting plate, and three foot position devices that are movably attached to the strip of material to indicate the batter's feet position during batting. Additional strips of material may be attached to the first strip of material to form a batting box in which the batter stands during batting. The first strip may have indicia thereon so that the positioning of strips of material to indicate the batter's feet position may be noted for each batter. The strips and foot placement devices may be made of flexible material, for example, heavy cloth, canvas, and various plastic materials. The use of flexible material permits the stance training device to be folded or rolled to reduce its size for carrying and storage.

DESCRIPTION OF A PREFERRED EMBODIMENT

Figure 1:
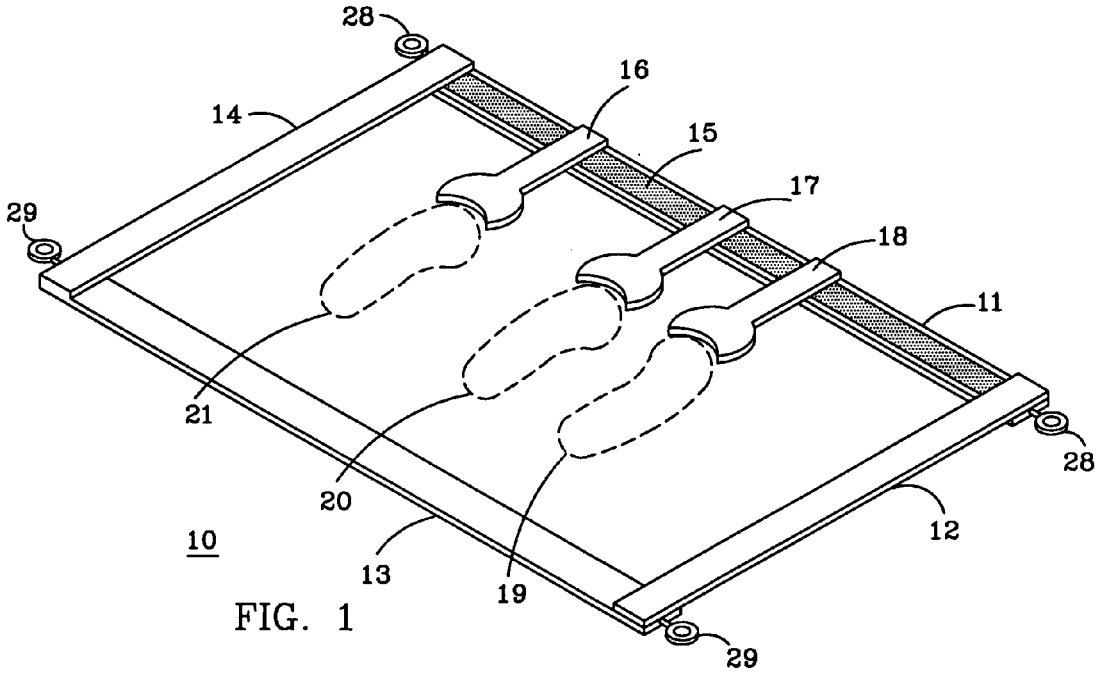
FIG. 1 is an isometric view of the batter stance training device of the invention.

FIG. 1 is an isometric view of one embodiment of the invention Batter stance device 10. Device 10 includes a first strip 11 and moveably mounted foot position indicators 16, 17 and 18 that are moveably mounted on strip 11. Strip 11 has, for example, a strip of hook and loop fastener material 15 on one side to which the foot position indicators 16–18 are moveably attached. The position of each of foot indicator 16–18 depends upon each individual batter. The position is determine for the best batting stance of a batter. Once the position of each foot position indicator is determined for each batter, they can be position for that batter during batting training and practice.

In use, a batters foot is positioned as indicated by the foot prints 19, 20 and 21, adjacent to its respective foot position indicator 16–18. Foot prints 19 and 20 shoe right and left foot positions, and foot print 21 shows the step forward position of the left foot as the batter steps forward during batting. Foot prints 19, 20 and 21 are indicated by dashed lines since they are not a part of the stance device 10.

Batting stance device 10 may include additional strips 12, 13 and 14, to provide an outline of an area in which the batter stands while batting. Strip 13 is position parallel to strip 11 and strips 12 and 14 attached stip 13 to strip 11 to form the batters box or standing area. Strips 12 and 14 are attached to strips 11 and 13 by a fastener, for example, a hook and loop fastener or a snap fastener.

While not necessary, the device 10 may be held in a fixed position by inserting pins (not illustrated) into openings 28 in strip 11 and openings 29 in strip 13.

Figure 2:
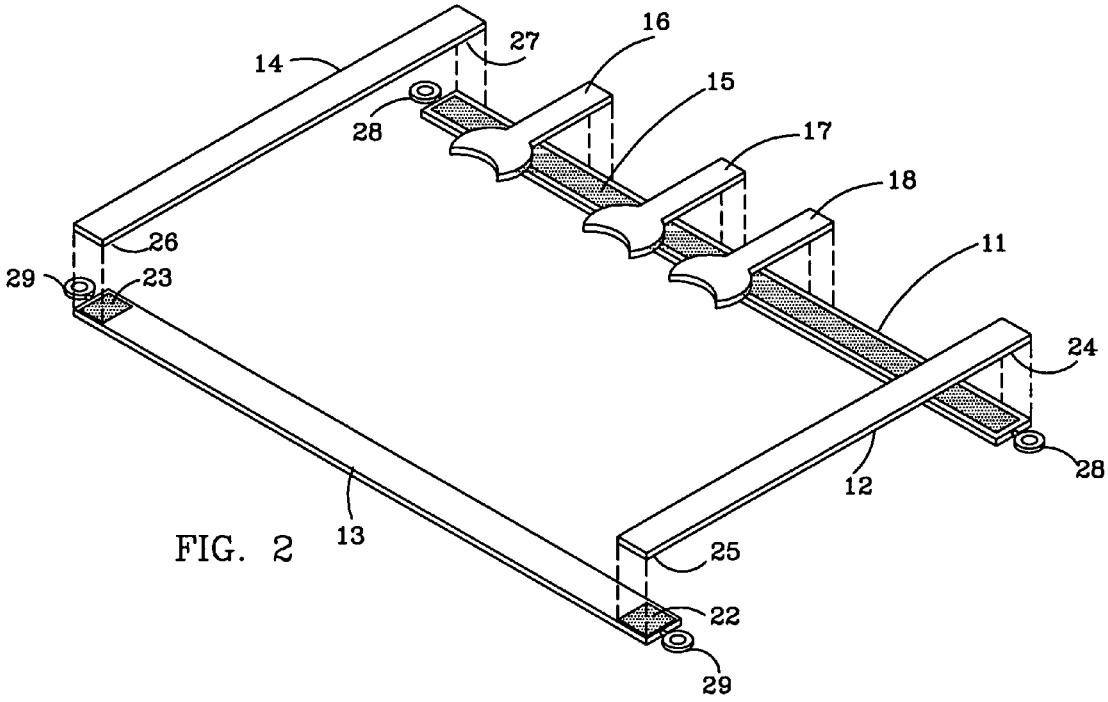
FIG. 2 shows an exploded view of the various parts of the stance training device.

FIG. 2 is an exploded view of batter stance device 10. In this view, each of the illustrated components of the batter stance device 10 are detached from each other, showing the individual components. Each of the foot position indicators 16, 17 and 18 are shown in a position that is raised. Each foot position indicator has a hook and loop fastener on its underside (not illustrated) that fastens to hook and loop strip 15. Similarly, the ends of strips 12 and 14 have a hook and loop fastener, for example, there are fasteners 24 and 25 (not shown, but indicated) on the respective underside ends of strip 12 and fastener, and there are fasteners 26 and 27 (not shown, but indicated) on respective underside ends of strip 14. Openings 28, on strip 11 and openings 29 on strip 13 are shown.

Figure 3:
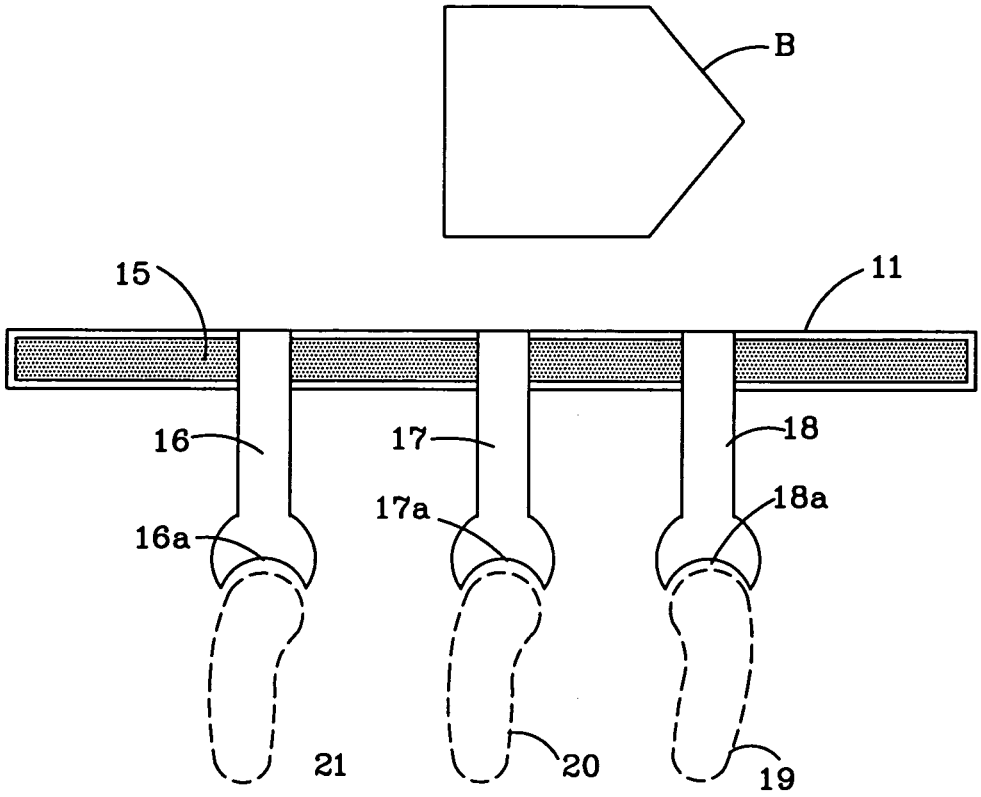
FIG. 3 is a top view of the stance training device showing the first strip positioned adjacent to a batting plate.

FIG. 3 shows the batter stance device position adjacent to a home plate B. The other strips (12, 13 and 14, illustrated in FIG. 1 and FIG. 2) are not shown as they are not always necessary. Strip 11 and foot position indicators 16–18 are attached to strip 11 and positioned for a particular batter. Right and left foot positions are indicated at foot positions 19 and 20. The step forward position of the left foot is indicated at 21.

Figure 4:
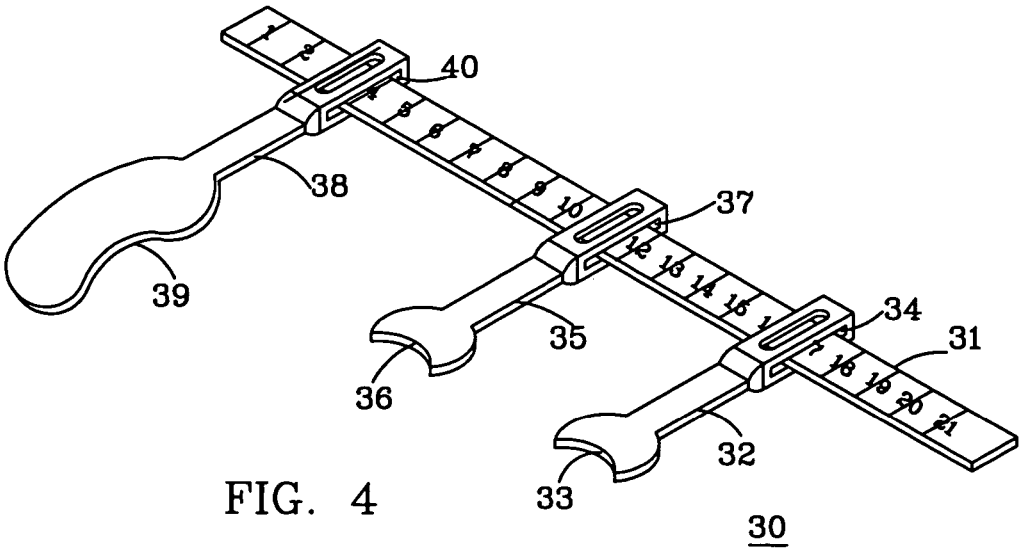
FIG. 4 shows another embodiment of the stance training device.

FIG. 4 illustrates a different embodiment of a batter stance device 30. Strip 31 has foot position indicators 32, 35 and 38 moveably mounted thereon. Each foot position indicated has a slot through which strip 31 extends. For example, foot position indicator 32 has a slot 34, foot position indicator 35 has a slot 37, and foot position indicator 38 has a slot 40. Each foot position indicator is moved along strip 31 to place it in its proper position.

Foot position indicator 32, 35 and 38 have openings 32*a*, 35*a* and 38*a*, respectively. These slot show the position of the foot position indicators along strip 31 and indicated by the indicia thereon. Each player can note his positions for right and left foot, and left foot step forward. As each player steps up to the batter box to practice batting, his individual setting can be used to properly position each of foot position indicators 32, 35 and 38.

As illustrated in FIG. 4, the right and left foot is position at 33 and 26, respectively. The step forward indicator 38 has an foot pattern 39 on which the foot is placed in the step forward position. This foot pattern may also be a part of the right and left foot position indicators in each of ch of FIGS. 1–13. A generic foot pattern (neither left of right foot) may be used so that if the batter is left handed, and the better stance device may be placed, flipped to the opposite side of the Home Plate B (indicated in FIG. 3). The generic foot pattern will not indicate right or left, but show the proper positioning of the feet.

What is claimed is:

1. A batting stance training device, comprising:

a first strip of material for positioning adjacent to a home plate;

second, third, and fourth strips, attached to each other and said first strip to form a batting box in which the batters stands adjacent to the foot position indicators; and a plurality of foot position indicators moveably attached and extending from the first strip of material, each foot position indicator having an edge against which a foot is placed during batting.

2. The batting stance training device according to claim 1, including a fastener extending partially along the length of the first strip of material, and a fastener attached to each of the foot position indicators to allow moveable attaching of the foot position indicators to the first strip.

3. The batting stance training device according to claim 1, including an opening in each end of the first strip to allow a it to be anchored in position by a pin device.

4. The batting stance training device according to claim 1, wherein said first strip is of a flexible material that may be folded or rolled into a small size to facilitate carrying and storage.

5. The batting stance training device according to claim 1, wherein said second, third, and fourth strips are of a flexible material that may be folded or rolled into a small size to facilitate carrying and storage.

6. The batting stance training device according to claim 1, wherein said foot positioning indicators include a generic outline of a foot.

7. The batting stance training device according to claim 1, wherein said plurality of foot position indicators are slidably mounted on said first strip.

8. The batting stance training device according to claim 1, including indicia thereon for indicating the position of each foot position indicators on said first strip.

9. The batting stance training device according to claim 8, wherein said foot position indicators have an opening therein through which the indicia on the first strip may be viewed to indicate the position of the foot position indicator location on the first strip.

10. A batting stance training device, comprising:

a first strip of material for positioning adjacent to a home plate;

a plurality of foot position indicators moveably attached and extending from the first strip of material, each foot position indicator having an edge against which a foot is placed during batting; and a plurality of additional strips of material for attaching to said first strip and to each other for forming a batter box around the foot position indicators.

11. The batting stance training device according to claim 10, including a fastener extending partially along the length of the first strip of material, and a fastener attached to each of the foot position indicators to allow moveable attaching of the foot position indicators to the first strip.

12. The batting stance training device according to claim 10, including an opening in each end of the first strip to allow a it to be anchored in position by a pin device.

13. The batting stance training device according to claim 10 wherein said first strip is of a flexible material that may be folded or rolled into a small size to facilitate carrying and storage.

14. The batting stance training device according to claim 10 wherein said additional strips of a material are of a flexible material that may be folded or rolled into a small size to facilitate carrying and storage.

15. The batting stance training device according to claim 10, wherein said foot positioning indicators include a generic outline of a foot.

16. The batting stance training device according to claim 10, wherein said plurality of foot position indicators are slidably mounted on said first strip.

17. The batting stance training device according to claim 10, including indicia thereon for indicating the position of each foot position indicators on said first strip.

18. The batting stance training device according to claim 17, wherein said foot position indicators have an opening therein through which the indicia on the first strip may be viewed to indicate the position of the foot position indicator location on the first strip.

* * * * *